US011146884B2

(12) United States Patent
Chang et al.

(10) Patent No.: US 11,146,884 B2
(45) Date of Patent: Oct. 12, 2021

(54) TRANSDUCER APPARATUS FOR HIGH SPEECH INTELLIGIBILITY IN NOISY ENVIRONMENTS

(71) Applicant: Audio Zoom Pte Ltd, Singapore (SG)

(72) Inventors: Joseph Sylvester Chang, Singapore (SG); Chai Lung Lee, Singapore (SG); Yin Sun, Singapore (SG); MingJie Sebastian Chang, Canberra (AU); Tong Ge, Singapore (SG)

(73) Assignee: Audio Zoom Pte Ltd, Singapore (SG)

( * ) Notice: Subject to any disclaimer, the term of this patent is extended or adjusted under 35 U.S.C. 154(b) by 0 days.

(21) Appl. No.: 16/661,177

(22) Filed: Oct. 23, 2019

(65) Prior Publication Data

US 2020/0059717 A1 Feb. 20, 2020

Related U.S. Application Data

(63) Continuation-in-part of application No. PCT/SG2018/050196, filed on Apr. 20, 2018.

(30) Foreign Application Priority Data

Apr. 23, 2017 (SG) ..... 10201703312R

(51) Int. Cl.
*G10K 11/16* (2006.01)
*H04R 1/10* (2006.01)
(Continued)

(52) U.S. Cl.
CPC ..... *H04R 1/1083* (2013.01); *G10L 21/0208* (2013.01); *G10L 21/0364* (2013.01);
(Continued)

(58) Field of Classification Search
CPC ..... H04R 1/1083; H04R 1/1016; H04R 1/46; H04R 3/005; H04R 2201/107;
(Continued)

(56) References Cited

U.S. PATENT DOCUMENTS 3,787,641 A 1/1974 Santori
4,607,383 A 4/1986 Ingalls
(Continued)

FOREIGN PATENT DOCUMENTS

JP 2001028794 A 1/2001
KR 20150030086 A * 3/2015
(Continued)

OTHER PUBLICATIONS

Foreign Communication from a Related Counterpart Application, International Search Report and Written Opinion dated Aug. 10, 2018, International Application No. PCT/SG2018/050196 filed on Apr. 20, 2018.
(Continued)

*Primary Examiner* — Ammar T Hamid

(57) ABSTRACT

A transducer apparatus to provide high speech-intelligibility in a noisy environment. The transducer apparatus comprises a vibration-sensing transducer adapted to be placed on the non-honey and non-cartilaginous, i.e., fleshy, part of the head of the user—either on the all-flesh part of the cheek or all-flesh under chin. The vibrations sensed are vibrations arising from the user's voice in his mouth and conducted to the surface of the fleshy area of the users cheek or under-chin, and not by bone vibration. The embodiments of the invention include its application into headsets, earsets and helmets; and a switching means; and a means to realize a vibration transducer from an acoustical microphone.

20 Claims, 6 Drawing Sheets

(a)

(b)

(51) Int. Cl.

| | |
|---|---|
| ***G10L 21/0208*** | (2013.01) |
| ***G10L 21/0364*** | (2013.01) |
| ***H04R 1/46*** | (2006.01) |
| ***H04R 3/00*** | (2006.01) |
| *G10L 21/0216* | (2013.01) |

(52) U.S. Cl.
CPC ..... *H04R 1/1016* (2013.01); *H04R 1/46* (2013.01); *H04R 3/005* (2013.01); *G10L 2021/02165* (2013.01); *H04R 2201/107* (2013.01); *H04R 2460/13* (2013.01)

(58) Field of Classification Search
CPC ..... H04R 2460/13; G10L 21/0208; G10L 21/0364; G10L 2021/02165
USPC ..... 381/71.6
See application file for complete search history.

(56) References Cited

U.S. PATENT DOCUMENTS 5,282,253 A 1/1994 Konomi
5,404,577 A * 4/1995 Zuckerman ..... A42B 3/30 455/351
9,363,596 B2 6/2016 Dusan et al.
2005/0244020 A1 11/2005 Nakajima et al.
2008/0163747 A1 7/2008 Uehara et al.
2010/0172519 A1 7/2010 Kimura
2011/0026722 A1* 2/2011 Jing ..... G10L 25/84 381/71.1
2012/0278070 A1* 11/2012 Herve ..... G10L 21/0208 704/226
2013/0226020 A1* 8/2013 Holley ..... A61B 5/4806 600/529
2013/0238340 A1* 9/2013 Walsh ..... H04R 1/1041 704/260
2016/0142834 A1* 5/2016 Beevers ..... H04R 25/554 381/315

FOREIGN PATENT DOCUMENTS

KR 1020150030086 A 3/2015
WO 2018199846 A1 1/2018

OTHER PUBLICATIONS

"Knowles BU Series Accelerometer" Product Highlights, Digi-Key Electronics, https://www.digikey.com/en/product-highlight/k/knowles/bu-series-accelerometer, retrieved Oct. 23, 2019.

* cited by examiner

83

TRANSDUCER APPARATUS FOR HIGH SPEECH INTELLIGIBILITY IN NOISY ENVIRONMENTS

CROSS-REFERENCE TO RELATED APPLICATION

The present application is a Continuation-in-Part of International Application No. PCT/SG2018/050196, filed Apr. 20, 2018, entitled "TRANSDUCER APPARATUS FOR HIGH SPEECH INTELLIGIBILITY IN NOISY ENVIRONMENTS," which claims priority to Singapore Application No. SG 10201703312R filed with the Intellectual Property Office of Singapore on Apr. 23, 2017 and entitled "Bucca and Under-Chin Microphone for High Speech Intelligibility in Noisy Environments," both of which are incorporated herein by reference in their entirety for all purposes.

TECHNICAL FIELD

Embodiments of the invention relate to a transducer apparatus embodying a transducer/transducers and its/their arrangements and adaptions to improve speech intelligibility.

BACKGROUND OF THE INVENTION

Communications via acoustical microphones in noisy (low acoustical signal-to-noise ratio) environments are challenging. A vibration-sensing transducer, such as an accelerometer, also known as a bone conduction microphone or vibration-sensing microphone, is often used. It potentially offers high speech-intelligibility as it does not sense the environmental acoustical sounds but senses the vibrations of the surface where it is placed on.

It should be appreciated that accelerometer manufacturers, e.g. Knowles Electronics, recommend that the accelerometer be placed "on the throat, or touching a honey part of the head" [Knowles BU Series Accelerometer]. Other manufacturers of accelerometers similarly stipulate the same—placement on the throat or boney part of the head.

The placement of the accelerometer in prior-art inventions is always on either the boney or the cartilaginous parts of the user's head, i.e., (i) On the boney/cartilaginous throat, e.g., Ingalls' invention in U.S. Pat. No. 4,607,383A, Uehara et al.'s invention in US 2008/0163747 A1, and Kitamura's invention in JP2001028794A;

(ii) On top of the boney skull, e.g., Santori's invention in U.S. Pat. No. 787,641A;

(iii) On the boney mastoid, boney temple, boney part of the cheek (e.g., in the pad surrounding the cup of a headphone), e.g. Nakajima, et al.'s invention in US20050244020 A1, Kimura's invention in US20100172519A1; and Herve, et al.'s invention in USA 2012/0278070; and (iv) In the cartilaginous concha and/or cartilaginous ear canal, e.g., Konomi's invention in EPO 005009851 A1, and Dusan et al.'s invention in U.S. Pat. No. 9,363,596.

It is particularly important to note that prior-art placement of vibration-sensing transducers is strictly either on the boney (skull, mastoid or temple) or cartilaginous (throat, concha or ear canal) parts of the head—as stipulated by the manufacturers of accelerometers.

The speech intelligibility of the vibration-sensing transducer sensing vibrations from a user's voice from these prior-art placements—either on the boney/cartilaginous throat or boney part of the head (including boney part of the cheek)—is unsatisfactory for two reasons. First, voiced sounds (vowels) are strongly sensed (strong vibrations) and the unvoiced sounds (fricatives) are weakly sensed (weak vibrations), if any. Second, the transients of the sensed sounds are distorted, often resulting in poorly enunciated speech, often described as 'slurred speech', 'mumbled speech', 'dysarthia', etc.

Put simply, a high speech-intelligibility vibration-sensing transducer apparatus for noisy environments remains unavailable.

This includes the need for innovative positioning of transducers different from the prior-art positioning of the vibration-sensing transducer on the human head, i.e., placement other than that on the boney/cartilaginous throat or boney part of the head (including boney part of the cheek).

SUMMARY OF THE INVENTION

Generally, the invention relates to providing high speech-intelligibility preferably from a vibration-sensing transducer (e.g., an accelerometer, vibration-based microphone, shock sensor, gyroscope, vibration microphone or vibration sensor) adapted to be placed on a previously unplaced part of the human head—where transducers have not been placed in prior-art inventions. Specifically, the vibration-sensing transducer is placed on the non-boney and non-cartilaginous, i.e., the fleshy, part of the head of the user—either on the all-flesh part of the cheek (Fleshy Cheek or the mala) or all-flesh under the chin (Fleshy Under-Chin). The vibrations sensed are vibrations arising from the user's voice in his mouth—these vibrations are conducted to the surface of the fleshy area of the user's cheek (or Fleshy Under-Chin) through the flesh of the user's cheek (or Fleshy Under-Chin).

These vibrations are not due bone conduction. Because of this, the vibrations sensed on the fleshy part of the cheek (or Fleshy Under-Chin) include non-voiced sounds such as fricatives. Prior-art sensing by bone-conduction is unable to sense fricatives because there is no vibration, and consequently there is no conduction of vibrations during the formation of fricatives in the user's mouth. This lack of vibration is because unlike voiced sounds, fricatives do not involve the chopping of the air passing through the user's vocal cords.

In the embodiment of the invention, there are several methods for obtaining high speech-intelligibility from an accelerometer adapted to be placed on the fleshy part of the user's head, specifically his Fleshy Cheek or his Fleshy Under-Chin. The methods described herein include four embodiments of the invention, with one or more variations in each embodiment, ranging from adaption of the accelerometer to different types of earsets (earphones-sets), headsets (headphone-sets) and helmets; and combinations of accelerometer and acoustical microphone outputs. The accelerometer may be used in conjunction with a miniature loudspeaker that may be placed in/on/over the pinna as a earbud, earphone, headphone or within a helmet as part of a communications earset, headset, or helmet.

The accelerometer may be replaced by an acoustical microphone, such as an electret microphone, whose input acoustical port is adapted to be placed on the non-boney and non-cartilaginous part of the human head. The adaption of the input acoustical port of the acoustical microphone includes an arrangement such that it is fully closed, i.e., sealed where the input acoustical port is covered by a membrane or the input acoustical port is covered by the skin of the non-boney and non-cartilaginous part of the human head. This fully closed input port microphone, termed 'enclosed microphone' herein, prevents the environmental acoustical sounds from being sensed by the acoustical microphone. The enclosed acoustical microphone when placed on the non-boney and non-cartilaginous part of the human head would sense the vibrations thereon.

This summary does not describe an exhaustive list of all aspects of the present invention. It is anticipated that the present invention includes all methods, apparatus and systems that can be practiced from all appropriate combinations and permutations of the various aspects in this summary, as well as that delineated below. Such combinations and permutations may have specific advantages not specially described in this summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention herein are not necessarily to the same embodiment, and they mean at least one.

For sake of brevity, the vibration-sensing transducer (accelerometer, vibration-based microphone, shock sensor, gyroscope, vibration microphone or vibration sensor) will be termed 'accelerometer' henceforth, although these terms may be used interchangeably.

FIG. 1(*b*) shows prior-art placement of an accelerometer either on the skull (boney part of the head) or on the throat (cartilaginous part of the head). FIG. 1(*c*) shows the prior-art placement of an accelerometer in a ear muff hearing protector (hence on temple or the boney part of the cheek). FIG. 1(*d*) shows the prior-art transducer apparatus comprising an acoustic-sensing microphone on an arm.

FIG. 5(*c*) shows the third variation where part of the transducer apparatus can be clipped to the side of the helmet. FIGS. 5(*d*) and 5(*e*)—the two configurations of this third variation—show the helmet with the transducer apparatus mounted on the helmet. In this third preferred embodiment of the invention, the accelerometer is placed on the fleshy part of the cheek of the user.

DETAILED DESCRIPTION

Figure 1A:
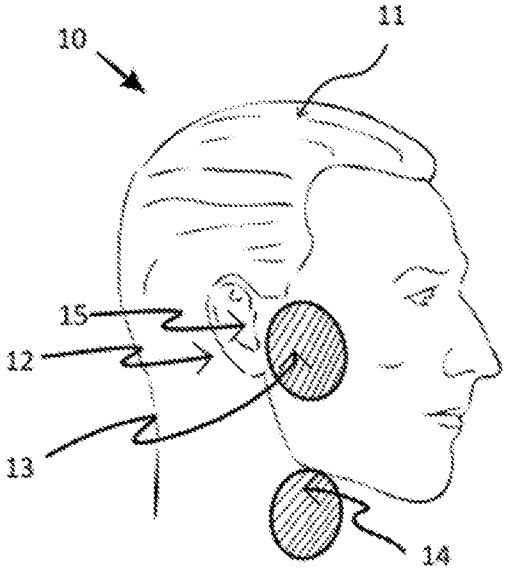
FIG. 1A (Prior Art)
FIG. 1(*a*) shows the lateral view of a human head with the prior-art placements of an accelerometer—either on the boney part (top of skull, mastoid or temple) or on/in cartilaginous part (throat, concha or ear canal) of the head.
Figure 1B:
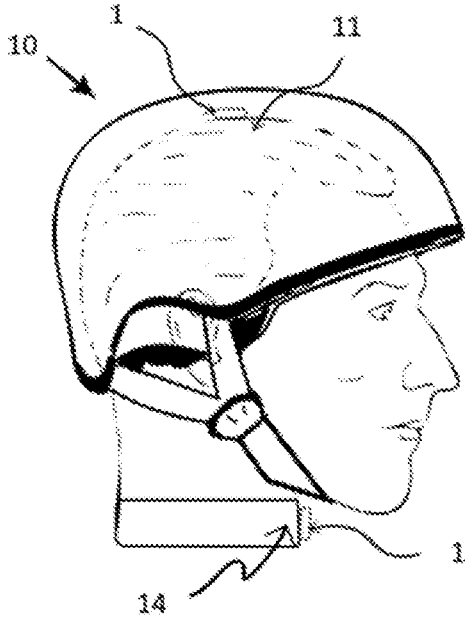
FIG. 1B (Prior Art)
Figure 1C:
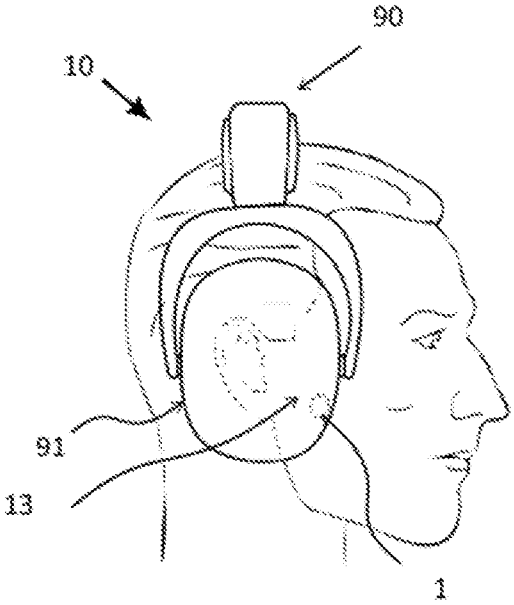
FIG. 1C (Prior Art)
Figure 1D:
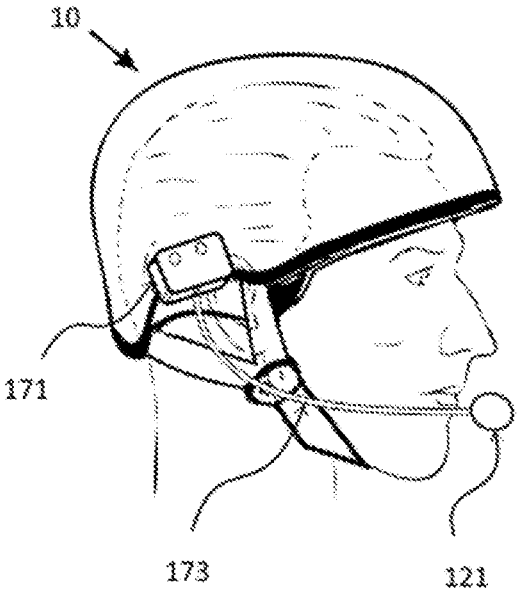
FIG. 1D (Prior Art)

Numerous specific details are set forth in the following descriptions. It is however understood that embodiments of the invention may be practiced with or without these specific details. In other instances, circuits; structures, methods and techniques that are known do not avoid obscuring the understanding of this description. Furthermore; the following embodiments of the invention may be described as a process; which may be described as a flowchart; a flow diagram; a structure diagram, or a block diagram. The operations in the flowchart, flow diagram, structure diagram or block diagram may be a sequential process, parallel or concurrent process, and the order of the operations may be re-arranged. A process may correspond to a technique, methodology, procedure, etc.

FIG. 1(*a*) depicts the prior-art placement of an accelerometer as a contact microphone (i.e., vibration-sensing transducer which maybe a microphone, shock sensor, gyroscope, vibration microphone or vibration sensor) where it is strictly placed either on the boney part of Head 10 (specifically the top of Skull 11, Mastoid 12 or Temple 13) or on the cartilaginous part of Head 10 (specifically, Throat 14, or in the concha or Ear Canal 15). The accelerometer senses the vibration from the surface of these boney or cartilaginous parts of human Head 10.

In particular, note that prior-art placements are never on the fleshy part of the human head, and consistent with the data sheet of accelerometer manufacturers—that the accelerometer be placed "on the throat, or touching a boney part of the head" [Knowles BU Series Accelerometer].

Congruous with the data sheet of accelerometer manufacturers and prior-art placements of the accelerometer in prior-art inventions, FIG. 1(*b*) shows the prior-art placement of Accelerometer 1 placed on top of Skull 11 or on Throat 14. These are the placements in Ingalls' invention in U.S.

Pat. No. 4,607,383A, Uehara et al.'s invention in US 2008/0163747 A1 Kitamura's invention in JP2001028794A, Santori's invention in U.S. Pat. No. 787,641A, etc.

FIG. 1(*c*) shows another prior-art placement of the accelerometer in the ear pad of Earcup 91 of Headset 90. Also congruous with the data sheet of accelerometer manufacturers, Accelerometer 1 is placed on Temple 13 (or boney part of cheek—not the fleshy part of the cheek). Prior-art inventions with Accelerometer 1 is placed on Temple 13 include Nakajima, et al.'s invention in US20050244020 A1, Kimura's invention in US20100172519A1; Herve; et al.'s invention in USA 2012/0278070, etc.

FIG. 1(*d*) shows the prior-art placement of a microphone assembly where Microphone 121 is attached to Arm 173 and Arm 173 is connected to the Enclosure 171 of the transducer apparatus. In particular, in prior-art inventions, for noisy applications, Microphone 121 is placed in front of the mouth and Arm 173 extends beyond the edge of the user's mouth. This is different from one of the embodiments of the invention in FIGS. 5(*d*) and 5(*e*)—see later. It is also pertinent to note that Microphone 121 does not need to touch the skin, unlike the embodiments of the invention.

Figure 2:
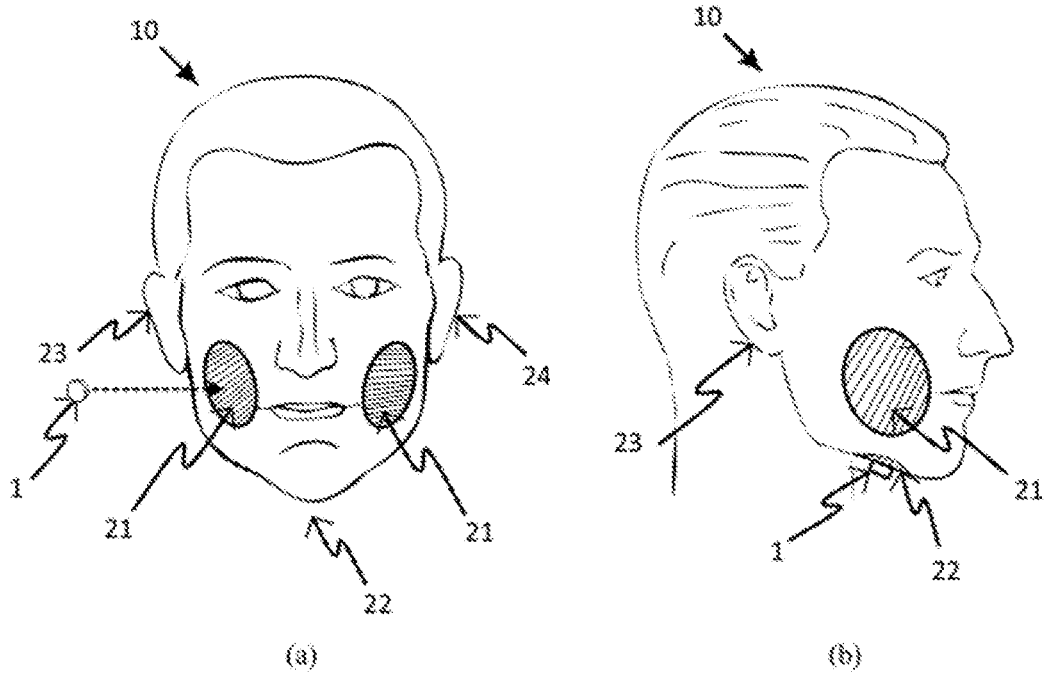
FIGS. 2(*a*) and 2(*b*) respectively shows the anterior view and lateral view of a human head, illustrating the non-boney and non-cartilaginous parts—the all fleshy part of the human head where an accelerometer may be placed in accordance with the general embodiment of the invention.

FIGS. 2(*a*) and 2(*b*) depict an embodiment of the invention where Accelerometer 1 is adapted to be placed on the non-honey and non-cartilaginous part of the users head 10 viewed respectively from the anterior and lateral perspective. The specific placement of the Accelerometer 1 is on Fleshy Cheek 21 on either side of his face or Fleshy Under-Chin 22. As the accelerometer touches or presses against his Fleshy Cheek 21 or Fleshy Under-Chin 22, the accelerometer senses the vibrations arising from the user's voiced and unvoiced sounds, thereby providing high speech-intelligibility. There are several ways for the aforesaid adaptation and these are described as variations of this embodiment of this invention.

FIG. 2(*a*) depicts the embodiment of the invention where Accelerometer 1 is placed on the Fleshy Cheek 21 on the right (or left) side of the user's face. Accelerometer 1 may alternatively be placed on the Fleshy Under-Chin 22 of the user's face as depicted in FIG. 2(*b*). An adhesive material or a double-sided tape may be applied on one surface of Accelerometer 1 such that when it is placed onto the user's Fleshy Cheek 21 or Fleshy Under-Chin 22, it remains in the same position. Alternatively, Accelerator 1 may be placed under a larger sticky patch, similar to a plaster whose adhesive part extends beyond Accelerator 1, where the patch with Accelerometer 1 is placed on the Fleshy Cheek 21 or the Fleshy Under-Chin 22 of the user; see FIG. 9(*b*) later. This means of adapting Accelerometer 1 to be placed either on the Fleshy Cheek 21 or the Fleshy Under-Chin 22 of the user is preferably used in applications where a small factor is required, e.g., in applications where the user desires as little obstruction as possible on his face, such as when wearing a gas mask, etc.

Figure 3:
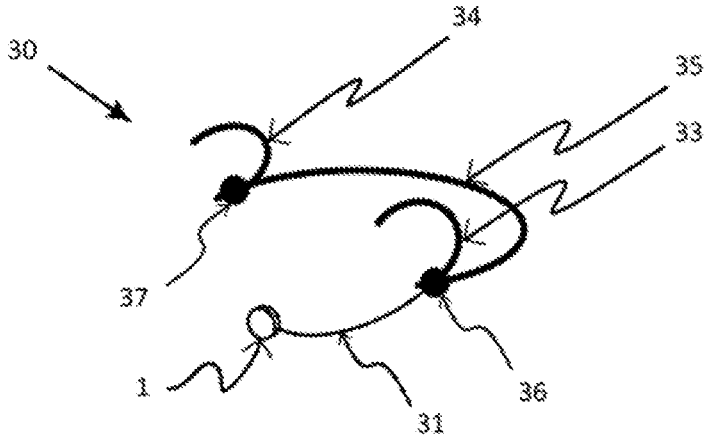
FIG. 3 shows a thin earhook-type earset embodying a pair of earhooks, back headband, and the integration of an accelerometer, and in accordance with the first preferred embodiment of the invention. The earhook-type earset may be worn as is or under a helmet where most parts of the earset are sandwiched between the user's head and helmet.

FIG. 3 depicts the first preferred embodiment of the invention involving Earset 30 comprising Accelerometer 1 mounted on one end of Arm 31. This earset resembles that used by human speakers making presentations where an acoustical microphone is used in place of Accelerometer 1. The other end of Arm 31 is attached to Left Earhook 33 as shown on Arm Mount 36 or it may be (not shown) attached to the Right Earhook 34 on Arm Mount 37. Left Earhook 33 is connected to Right Earhook 34 by the Back Headband 35. The user uses Earset 30 by placing Left Earhook 33 over his Left Pinna 24, placing Right Earhook 34 over his Right Pinna 23, and with Back Headband 35 placed around the back base of his Head 10. Arm 31 may be a flexible pre-formed arm or it may be a gooseneck-like arm that may be bent, such that Accelerometer 1 touches or presses against the Fleshy Cheek 21 or the Fleshy Under-Chin 22 of the user.

Note that the prior-art placements on Temple 13 (FIG. 1(*a*)) or boney part of the cheek is avoided because fricatives cannot be sensed and the sound quality is distorted.

The frame of Earset 30, including Left Earhook 33, Right Earhook 34 and Back Headband 35, is preferably thin. Being thin, the user may wear a helmet while wearing this Earset 30, i.e., the helmet is worn over Earset 30 where the Left Earhook 33, Right Earhook 34 and part of Back Headband 35 will be sandwiched between the user's Head 10 and the helmet. Depending on the helmet type, part or all of Arm 31 and the Accelerometer 1 may also be sandwiched between the user's face and the helmet. In cases where the helmet frame does not cover the Fleshy Cheek 21 of the user, a part of Arm 31 extends beyond the helmet and the Accelerometer 1 may be arranged such that the Accelerometer 1 touches or presses against the Fleshy Cheek 21 or the Fleshy Under-Chin 22 of the user. Earset 30 may also include a miniature loudspeaker (not shown), such as a earbud or earphone. Accelerometer 1 and loudspeaker may be connected to an electronic communications device such as a 2-way radio, smartphone, etc.

Figure 4A:
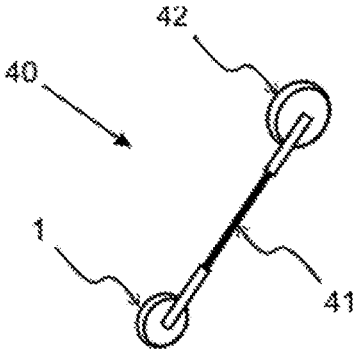
FIGS. 4(*a*), 4(*b*) and 4(*c*) show three different variations of a earset with the integration of an accelerometer, and in accordance with the second preferred embodiment of the invention. They are respectively without a earhook or headband, with a earhook, and with a headband.
Figure 4B:
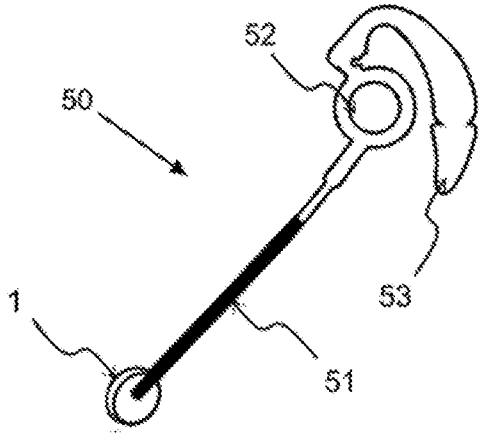
Figure 4C:
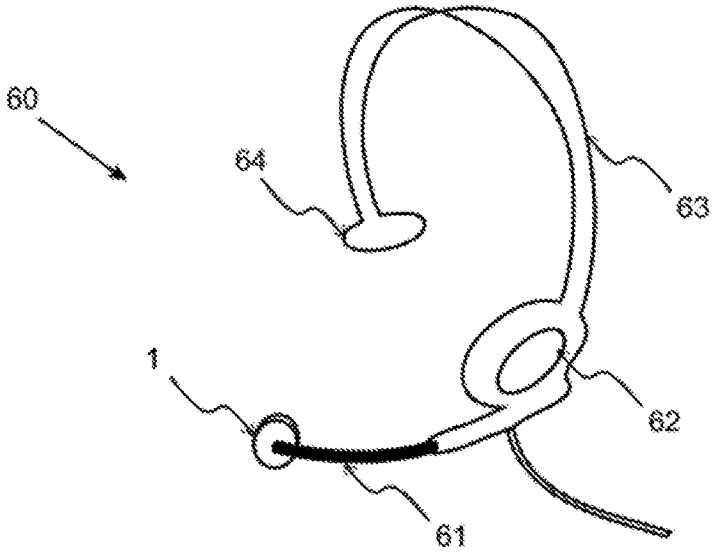
Figure 5A:
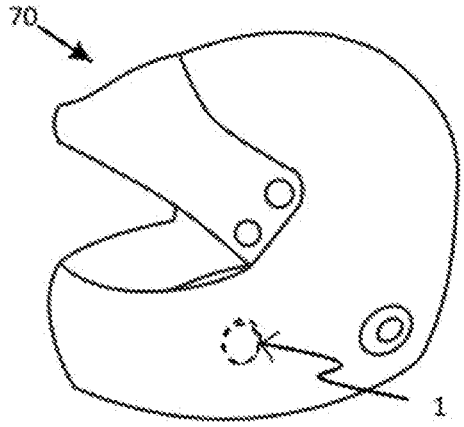
FIGS. 5(*a*)-5(*b*) show the third preferred embodiment of the invention involving helmets. In these first two variations of this third preferred embodiment, the accelerometer is embedded into the section of the first helmet that covers the users Fleshy Cheek and embedded in its straps in the second helmet.
Figure 5B:
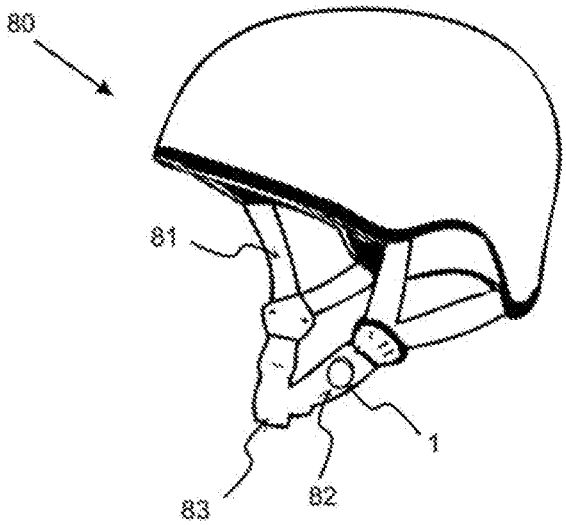
Figure 5C:
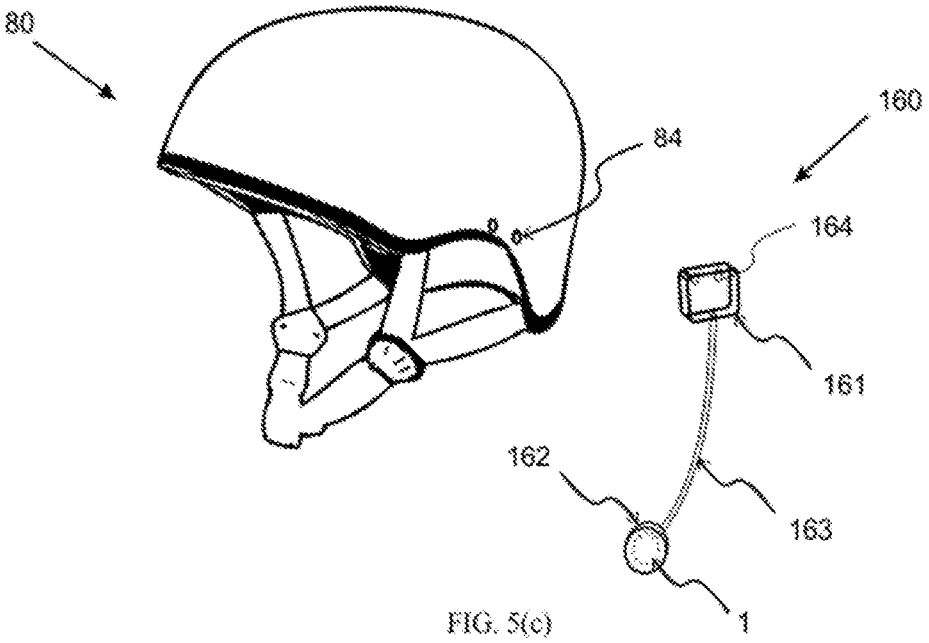
Figure 5D:
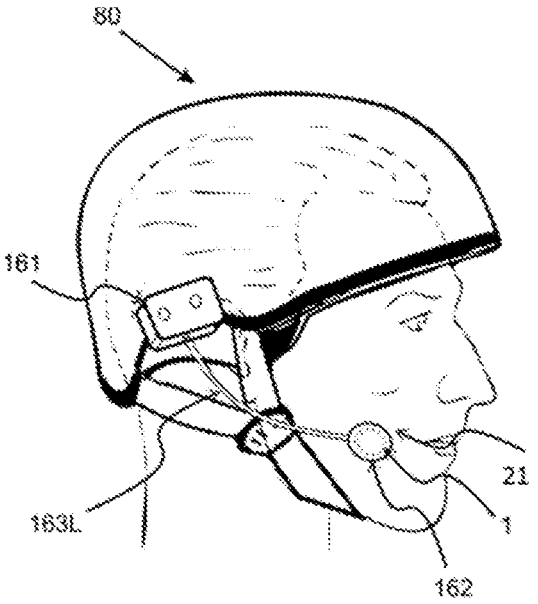
Figure 5E:
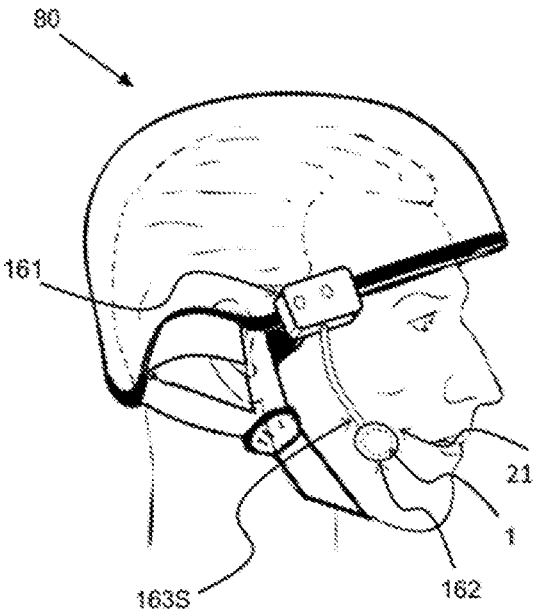

FIGS. 4(*a*)-4(*c*) depict the second preferred embodiment of the invention including Accelerometer 1 that is adapted to be placed such that it touches or presses against the Fleshy Cheek 21 or the Fleshy Under-Chin 22 of the user. This configuration involves a number of possible variations in the form of different earsets or headsets. These different variations may involve a miniature loudspeaker that may be in the form of a earphone/earbud that is placed in the Ear Canal/Concha 15 of the user or in the form of a headphone that is placed on/over his Pinna 23 or 24.

FIG. 4(*a*) depicts the first variation of the second preferred embodiment of the invention where Earset 40 embodies Accelerometer 1, Earphone 42 and Arm 41 connecting Accelerometer 1 and Earphone 42, Earphone 42 may be placed into the Concha or Ear Canal 15 of the user. Accelerometer 1 is adapted to be placed by means of Arm 41 such that it touches or presses against Fleshy Cheek 21 or Fleshy Under-Chin 22 of the user. For example, when the user wears Earset 40 under his helmet, Accelerometer 1 is arranged to touch or press against Fleshy Cheek 21 of the user. Alternatively, without the helmet, Accelerometer 1 may be adhered to Fleshy Cheek 21 or the Fleshy Under-Chin 22 of the user by means of an adhesive or double-sided tape. Also alternatively, the user may physically place (or press) Accelerometer 1 on his Fleshy Cheek 21 or his Fleshy Under-Chin 22 when desired, for example when he wishes Accelerometer 1 to pick up his voice vibrations.

FIG. 4(*b*) depicts the second variation of the second preferred embodiment of the invention where Earset 50 embodies Accelerometer 1, Earphone 52, Earhook 53, and Arm 51 connecting Accelerometer 1 and Earphone 52 or Earhook 53. Earphone 52 may be placed into Concha 15 of the user or in the form of a headphone that is placed on/over the Pinna 23 or 24 of the user. Earhook 53 may also be in the form that completely encloses the back of the Pinna 23 or 24, thereby providing more secure placement of Earset 50 than that depicted in FIG. 4(*b*). Accelerometer 1 is adapted to be placed, by means of Arm 51, such that it touches or presses against Fleshy Cheek 21 or Fleshy Under-Chin 22 of the user. For example, when the user wears Earset 50 under his helmet, Accelerometer 1 is arranged to touch or press against Fleshy Cheek 21 of the user. Alternatively, without the helmet, the Earhook 53 placed over and under the Pinna 23 or 24 may provide sufficient anchorage for Accelerometer 1 to touch or press onto the Fleshy Cheek 21 or the Fleshy Under-Chin 22 of the user. Should the anchorage be insufficient, the user may physically place (or press) Accelerometer 1 on his Fleshy Cheek 21 or Fleshy Under-Chin 22 when desired.

FIG. 4(*c*) depicts the third variation of the second preferred embodiment of the invention where Headset 60 embodies Accelerometer 1, Headphone 62, Over-the-head Band 63, and Arm 61 connecting Accelerometer 1 to either Headphone 62 or Over-the-head Band 63, Headphone 62 is preferably placed on/over Pinna 23 or 24 of the user, thereby covering his Concha or Ear Canal 15. Accelerometer 1 is be placed, by means of Arm 61, such that it touches or presses against Fleshy Cheek 21 or Fleshy Under-Chin 22 of the user. Over-the-head Band 63 and Headphone 62 would provide sufficient anchorage for Accelerometer 1 to touch or press Fleshy Cheek 21 or Fleshy Under-Chin 22 of the user. Should the anchorage be insufficient, the user may physically place (or press) Accelerometer 1 on his Fleshy Cheek 21 or Fleshy Under-Chin 22 when desired. The Over-the-head Band 63 may also be in the form of an over-the-neck band. The other end of Headband 64 may be another headphone or simply a pad that sits on or near the Right Pinna 24 of the user.

FIGS. 5(*a*) and 5(*b*) depict the fourth configuration of the embodiment of the invention where the Accelerometer 1 is either embedded into the helmet 70 or in the straps 81 of helmet 80 or helmet 70 (not shown) respectively. The Accelerometer 1 is adapted to be placed such that it touches or presses against the Fleshy Cheek 21 or the Fleshy Under-Chin 22 of the user. Helmet 70 may further embody a loudspeaker (not shown) that is preferably physically flat such that when the user wears the helmet 70, the loudspeaker is placed over the user's pinna 23 or 24. In the case of helmet 80, it may also embody a loudspeaker that is also preferably physically flat such that it is placed in the strap or under the helmet 80 such that the loudspeaker is close to the pinna 23 or 24 of the user.

FIGS. 5(*a*)-5(*d*) depicts the third preferred embodiment of the invention involving helmets. The first variation is where Accelerometer 1 is embedded into Helmet 70. This would largely be appropriate only if the frame of Helmet 70 covers at least part of the Fleshy Cheek 21 of the user and helmets types such as the Full-Face, Open-Face, Modular, Off-Road, and Dual-Sport may be appropriate; some Open-Face helmets may also be appropriate. For the helmet to be appropriate, it is necessary for the frame of Helmet 70 to cover at least part of Fleshy Cheek 21 of the user as a means for Accelerometer 1 to be placed such that it touches or presses against the Fleshy Cheek 21 of the user when he wears Helmet 70. Helmet 70 may also embody a flat loudspeaker (not shown) such that it is placed near or over the pinna of the user when he wears Helmet 70.

FIG. 5(*b*) depicts the second variation of the third preferred embodiment of the invention where the frame of Helmet 80 does not cover the Fleshy Cheek 21 of the user. Examples of such helmets include the Half Helmet and some Open Face helmets. In this second variation, Accelerometer 1 is placed within Straps 81 of Helmet 80 and there are two preferred locations. The first preferred location is Location 82 in Straps 81 where Accelerometer 1 touches or presses against Fleshy Cheek 21 of the user when the user wears Helmet 80 and straps Straps 81 of Helmet 80. The second preferred location is Location 83 in Straps 81 where Accelerometer 1 touches or presses against the Fleshy Under-Chin 22 of the user when the user wears Helmet 80 and straps Straps 81 of helmet 80.

Further to the placement of Accelerometer 1 into Straps 81 of Helmet 80 in FIG. 5(*b*), Accelerometer 1 can likewise be placed into the straps (not shown) of Helmet 70 in FIG. 5(*a*). The placement in this case is preferably in the bottom of the straps similar to the Location 83 in Straps 81 Helmet 80 such that when the user straps the straps of Helmet 70, Accelerometer 1 touches or presses against the Fleshy Under-Chin 22 of the user.

FIG. 5(*c*) depicts the third variation of third preferred embodiment of the invention. In this variation, the Transducer Apparatus 160 comprises Arm 163 connected between Enclosure 161 and Enclosure 162. Enclosure 161 may be attached to Male Studs 84 on Helmet 80 via its own Female Studs 164. Accelerometer 1 is encased in Enclosure 162, while Enclosure 161 may contain circuits (e.g., condition circuit) or a connector assembly. FIGS. 5(*d*) and 5(*e*) show two configurations of this third variation of third preferred embodiment of the invention. In FIG. 5(*d*), Enclosure 161 is placed on further back of Helmet 80 while Enclosure 161 is placed more to the front of Helmet 80 in FIG. 5(*e*). In both cases, Accelerometer 1 is encased in Enclosure 162.

As Enclosure 161 is further at the back of Helmet 161 in FIG. 5(*d*), Arm 163L that connects Enclosure 161 to Enclosure 162 is somewhat long. Its length is such that when Enclosure 161 is attached to Helmet 80, Enclosure 162 touches Fleshy Cheek 21 and it does not extend beyond the side of the mouth of the user.

In the case of FIG. 5(*e*), Arm 163S that connects Enclosure 161 to Enclosure 162 is shorter because Enclosure 161 is placed further in front of Helmet 80. Its shorter length is such that when Enclosure 161 is attached to Helmet 80, Enclosure 162 touches Fleshy Cheek 21 and it does not extend beyond the side of the mouth of the user. Further the position of Arm 163S is approximately vertical. This facilitates wearing the helmet quickly.

Figure 6:
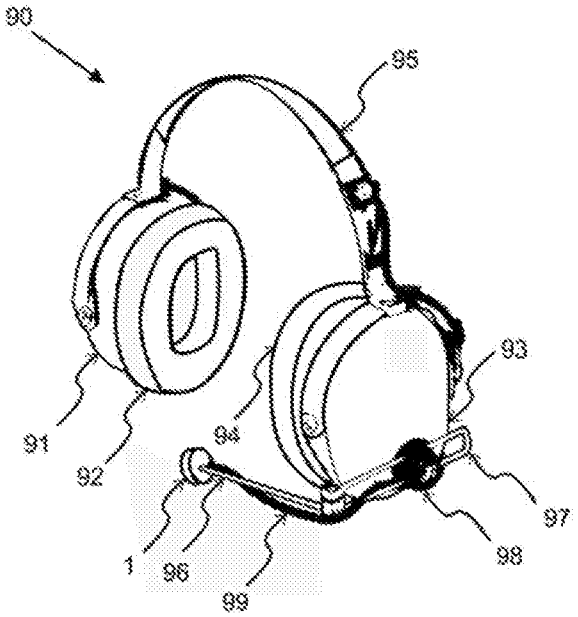
FIG. 6 shows the fourth preferred embodiment of the invention for a headset having two earcups that is generally used as a hearing protector (e.g., ear muff), communications headset, aviation headset, and the like. This embodiment integrates an accelerometer into an arm mounted on one of the earcups and adapted such that the accelerometer is positioned onto the fleshy part of the user's cheek.

FIG. 6 depict the fourth preferred embodiment of the invention involving a Headset 90 where Accelerometer 1 is adapted to be placed such that it touches or presses against the Fleshy Cheek 21 or the Fleshy Under-Chin 22 of the user. The headset having two earcups, Right Earcup 91 with Earpad 92 and Left Earcup 93 with Earpad 94, is generally used as a hearing protector (e.g., ear muff) for communications, as an aviation headset, communications headset, and the like. When the Headset 90 is worn by the user, Earpad 92 or 94 makes contact with the users face around his Pinna 23 or 24. Earcup 91 with Earpad 93 and Earcup 93 with earpad 94 enclose the entire Pinna 23 and 24 of the user. Each Earcup 91 or 93 may embody a loudspeaker as part of a communications headset.

In this headset, Headset 90 where one end of Arm 97 may be attached to or pivoted at Pivot 98 of the casing of Earcup 93, and the other extension Arm 96 (of Arm 97) that extends beyond Earcup 90 embodies Accelerometer 1. Accelerometer 1 is adapted to either touch or press against the Fleshy Cheek 21 or the Fleshy Under-Chin 22 of the user. This may include having the arm in a form of a two-part Arm 97 and 96 or a gooseneck or the like that may be bent accordingly. Accelerometer 1 may be connected by Wire 99 as part of the communications Headset 90.

Figure 7:
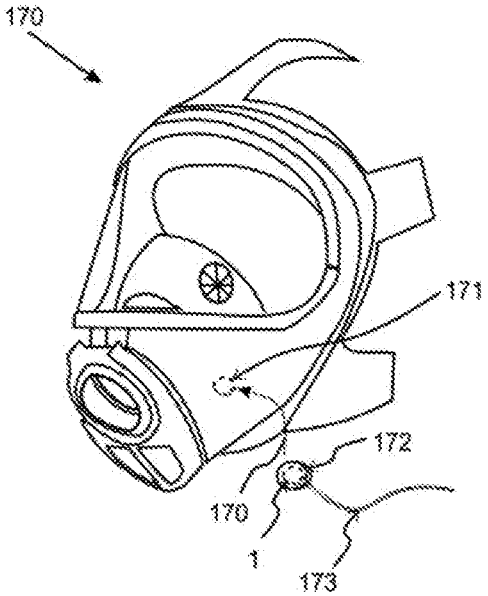
FIG. 7 shows the second embodiment of the invention involving a face mask, and the accelerometer is encased in an enclosure and is adapted to sense vibrations on the surface of the face mask. On this enclosure, a magnet or piece of metal is affixed. A magnet or metal is also affixed to the inner surface of the face mask, and is magnetically attracted to the enclosure.

FIG. 7 shows the second embodiment of the invention involving a face mask that is typically worn over the face of the user in smoky or atmospherically hazardous environments. Accelerometer 1 encased in Enclosure 172 is connected to Cable 173. A piece of Magnet or Metal 171 is affixed to an inner surface of Face Mask 170, preferably in an area near the mouth of the user when he wears Face Mask 170. Similarly, there is a piece of Metal or Magnet on one of the surfaces of Enclosure 172 (not shown) such that Enclosure 172 is magnetically attached to Magnet or Metal 171 in Face Mask 170. When Enclosure 172 touches or affixed to a surface of Face Mask 170, Accelerometer 1 senses the vibrations on Face Mask 170 where the vibrations are due to the voice of the user of Face Mask 170.

Another means of affixing Enclosure 172 to the surface of Face Mask 170 is by physical means. For example, a piece of Velcro (either Hook or Loop) may be affixed on the surface of Face Mask 170 while another piece of Velcro (either Loop or Hook) may be affixed to one of the surfaces of Enclosure 172. The opposing-type surfaces of the Velcro can then serve as an affixation means.

Another example is a mechanical fastening means. For example, the surface of Face Mask 170 could include a female-type fastening means while Enclosure 172 could serve as the male-type fastening means. The affixation could simply be the insertion of male-type fastening means of Enclosure 172 into female-type fastening means on Face Mask 170.

Figure 8A:
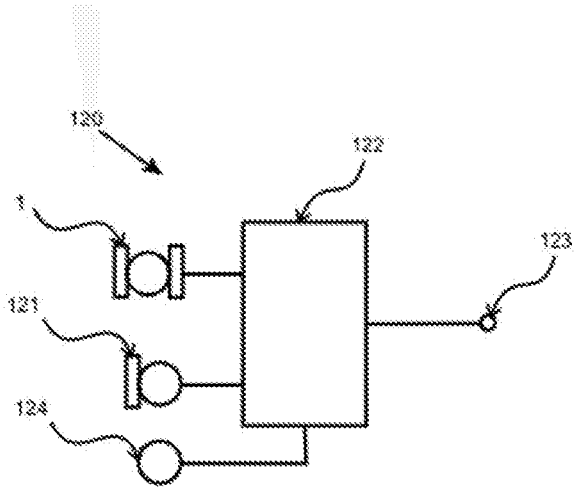
FIGS. 8(*a*) and (*b*) show two systems, in accordance with the third embodiment of the invention, comprising in various variations, an accelerometer, an acoustical microphone, a sensor, a switching means, and signal conditioners. In the first system, the switching means may be mechanical or automatic to select the accelerometer or the acoustical microphone, or a combination thereof. In the second system, the output of the accelerometer and the acoustical microphone may also be signal-conditioned in different ways.
Figure 8B:
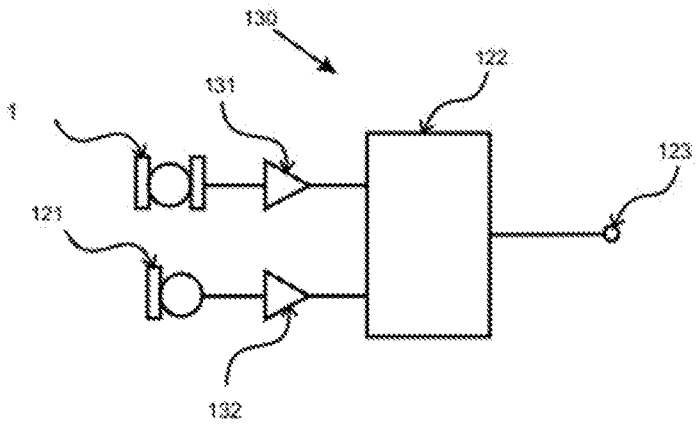

FIGS. 8(*a*) and 8(*b*) depict the third embodiment of the invention involving a system that includes Accelerometer 1 and Acoustical Microphone 121, and Switching Means 122 that selects either Accelerometer 1, Acoustical Microphone 121 or both, or the switching can be adapted such that either Accelerometer 1, Acoustical Microphone 121 or both is disabled. When this third embodiment of the invention is used in a communications device such as a smartphone or 2-way radio, the switching connects either Accelerometer 1, Acoustical Microphone 121 or both as the external microphone to the communications device, or they be either or both disabled. Accelerometer 1 is adapted to be placed such that it touches or presses against Fleshy Cheek 21 or Fleshy Under-Chin 22 of the user as in accordance with any of the previous embodiments of the invention. Acoustical microphone 121 may be placed anywhere, preferably adapted to be placed close to the mouth of the user. This placement includes Acoustical Microphone 121 placed physically close to Accelerometer 1, and they collectively placed near or touching/pressed on Fleshy Cheek 21 and near or touching/pressed on Fleshy Under-Chin 22 of the user. This placement includes any of that depicted in FIGS. 3-7 herein.

In System 120 in FIG. 8(*a*), Output 123 of Switching Means 122 is the transducer (either Accelerometer 1, or Microphone 121, or a combination thereof) output of the system that is in turn connected to an electronic device, e.g., 2-way radio or smartphone. Switching Means 122 is mechanical and may be a single-pole double-throw switch where the user manually selects either Accelerometer 1 or Acoustical Microphone 121. Accelerometer 1 may be preferably selected to be used in a noisy environment where Accelerometer 1 is arranged such that it touches or presses against the user's Fleshy Cheek 21 or Fleshy Under-Chin 22. Acoustical Microphone 121 may be selected to be used in a quiet environment or where the environmental noise is tolerable.

There are several variations to FIG. 8(*a*). In one variation, Switching Means 122 is automatic where there is Sensor 124 that detects when Accelerometer 1 effectively touches the human skin. There are several sensors that can sense this, including capacitive sensors and mechanical switches such as microswitches. When Sensor 124 detects that Accelerometer 1 touches or presses against the human skin, Switching Means 122 will select Accelerometer 1. Otherwise, Switching Means 122 will select Acoustical Microphone 121.

Further, in a second variation, Accelerometer 1 and Acoustical Microphone 121 may be enclosed in the microphone housing of the ubiquitous earphone set that embodies a pair of earphones and a microphone. The said microphone housing further embodies Sensor 124. In environments where the environmental noise is low or tolerable, the microphone housing may be placed away from (i.e., not touching) the users Head 10 (or skin). With this sensed by Sensor 124, Switching Means 122 selects Acoustical Microphone 121. When the environmental noise becomes intolerable, the user pushes microphone housing to touch his skin of his head, preferably against his Fleshy Cheek 21 or Fleshy Under-Chin 22. With the sensor sensing the skin contact, Switching Means 122 selects Accelerometer 121 which would sense the vibrations thereon according to an embodiment of the invention.

In a variation to this second variation, the connected electronic device, e.g., 2-way radio or smartphone, may embody computation means to ascertain if the (acoustical) environment is noisy from the signals picked up by Acoustical Microphone 121. If it is noisy, Acoustical Microphone 121 is disconnected and Accelerometer 1 is selected. The computation means also be embodied in Switching Means 122.

In a third variation, Switching Means 122 in said second variation may be overridden by the user.

In the fourth variation, the outputs of the both Accelerometer 1 and Acoustical Microphone 121 are combined, and if necessary individually weighted, as the output of Output 123 of Switching Means 122. The individual weighting may involve either the output of Accelerometer 1 or Acoustical Microphone 121 having more than 50% of the combined output of the system. For example, in a quiet, moderately noisy and noisy environment, the ratio of the output between Accelerometer 1 and Acoustical Microphone 121 may respectively be 0:100, 60:40 and 100:0. This weighting may be obtained by means of an attenuators or amplifiers with different gains.

FIG. 8(*b*) depicts the fifth variation embodying System 130. In System 130, the output of Accelerometer 1 is conditioned by Signal Conditioner 131, and the output of Acoustical Microphone 121 is conditioned by Signal Conditioner 132. In general, the electrical signal output levels of Accelerometer 1 Acoustical Microphone 121 are different, e.g. for the same sound pressure level of the user's voice, Acoustical Microphone 121 is higher. By means of the different signal conditioning in Signal Conditioners 131 and 132, the electrical output of Accelerometer 1 and Acoustical Microphone 121 may be adjusted accordingly as the inputs to Switching Means 122.

In the sixth variation, the signal conditioning in Signal Conditioners 131 and 132 may further include other signal conditioning parameters other than level adjustments (or amplifications), including frequency shaping of the output of Accelerometer 1 and Acoustical Microphone 121 outputs. For example, it may be desirable to shape the magnitude of the frequency response of Accelerometer 1 so that it its magnitude frequency response is similar to that of Acoustical Microphone 121.

Figure 9A:
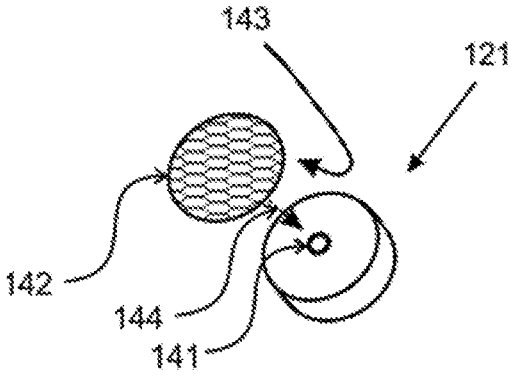
FIGS. 9(*a*) and 9(*b*) respectively show an acoustical microphone with its acoustical input port being closed (sealed, thereby obtained an enclosed microphone), and the enclosed microphone adhered to an adhesive patch. The enclosed microphone serves as a replacement of the accelerometer, and in accordance with the fourth embodiment of the invention.
Figure 9B:
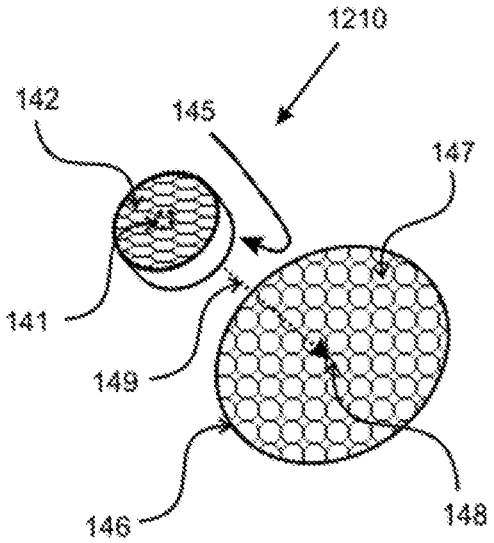

FIGS. 9(*a*) and 9(*b*) depict the fourth embodiment of the invention where Accelerometer 1 is replaced by Acoustical Microphone 121 whose Input Acoustical Port 141 is closed (sealed)—henceforth, termed the 'Enclosed Microphone' 1210. The Acoustical Microphone 121 may be of various types, including the inexpensive condenser electret microphone with a subminiature form-factor. Being inexpensive, the Enclosed Microphone 1210 may be disposable for hygiene reasons, ease of replacement, etc.

In FIG. 9(*a*), Acoustical Microphone 121 has an Input Acoustical Port 141. To close (seal) Input Acoustical Port 141, Membrane 142 is placed over the top surface (the surface having Input Acoustical Port 141) of Acoustical Microphone 121. This closing of Input Acoustical Port 141, hence sealing Input Acoustical Port 141, by Membrane 142 may be facilitated by the Back Surface 143 of Membrane 142 having an adhesive. Back Surface 143 of Membrane 142 may be adhered to the top surface of Microphone 121 in the direction pointed to by Arrow 144. As an embodiment of the invention, the top surface of Microphone 121 with the sealed Input Acoustical Port 141 is placed or pressed against the users Fleshy Cheek 21 or his Fleshy Under-Chin 22. Membrane 142 is preferably non-rigid so that it compliant to vibrations, thereby allowing Microphone 121 to sense vibrations. This compliance may be facilitated with a large-sized Input Acoustical Port 141.

The closing or sealing of the Input Acoustical Port 141 of Acoustical Microphone 121 may also be sealed if the top surface of Microphone 111 is properly placed against the Fleshy Cheek 21 or Fleshy Under-Chin 22 of the user. This may be facilitated by placing the base (145 in FIG. 9(*b*)) of Acoustical Microphone 121 on a large adhesive patch (146 in FIG. 9(*b*)) and adhering the large adhesive Patch 146 on the users Fleshy Cheek 21 or Fleshy Under-Chin 22.

In FIG. 9(*b*), Enclosed Microphone 1210—an acoustical microphone whose Input Acoustical Port 141 is sealed—is placed on Patch 146 whose Top Surface 147 is adhesive. This placement involves having Base 145 of Enclosed Microphone 1210 placed preferably near Center 148 of Patch 147 as indicated by Arrow 149. With Enclosed Microphone 1210 adhered to Patch 146, the patch may thereafter be placed on/adhered to the user's Fleshy Cheek 21 or his Fleshy Under-Chin 22 in accordance to an embodiment of the invention. Preferably, Membrane 141 touches or presses against the user's Fleshy Cheek 21 or his Fleshy Under-Chin 22, and being compliant to vibrations, Enclosed Microphone 1210 senses the vibrations thereon.

In all aforesaid embodiments and variations of the invention, Accelerometer 1 or Enclosed Microphone 1210 is adapted to be placed to touch or press against the user's Fleshy Cheek 21 or his Fleshy Under-Chin 22—not the boney or cartilaginous part of the human head in prior-art inventions and stipulated by accelerometer manufacturers. Accelerometer 1 or Enclosed Microphone 1210 may be adapted to have direct contact with the skin of the user's Fleshy Cheek 21 or his Fleshy Under-Chin 22, or encapsulated in other material(s) or placed against other materials that may in turn have contact with the skin of the user's Fleshy Cheek 21 or his Fleshy Under-Chin 22. The materials may provide mechanical vibration amplification such as an air bubble to increase the mechanical vibrations arising from the user's voice on his Fleshy Cheek 21 or Fleshy Under-Chin 22.

The aforesaid descriptions are merely illustrative of the principles of this invention and many configurations, variations, and various modifications can be made by those skilled in the art without departing from the scope and spirit of the invention. The foresaid embodiments may be designed, realized and implemented individually or in any combination or permutations.

What is claimed:

1. A transducer apparatus comprising a transducer, wherein the transducer is adapted to be placed on and to sense vibrations on the non-boney and non-cartilaginous part of the user's head, the vibrations arise from the user's voiced and unvoiced sounds, the non-boney and non-cartilaginous part of the user's head is the fleshy area of the user's cheek near the mouth of the user, and the vibrations include that arising from the user's speech are conducted to the surface of the fleshy area of the user's cheek through the flesh of the user's cheek.

2. The transducer apparatus according to claim 1, wherein the transducer is an accelerometer, shock sensor, gyroscope, vibration microphone or vibration sensor.

3. A transducer apparatus comprising a transducer, wherein the transducer is an acoustical microphone adapted to sense vibrations arising from the user's voiced and unvoiced sounds, the acoustical microphone having a housing, the housing having a hole that serves as the acoustical input port, the adaption of the acoustical microphone to sense vibrations is by means of the hole being placed on or pressed against the non-boney and non-cartilaginous part of said user's head, the non-boney and non-cartilaginous part of the user's head is the fleshy area of the user's cheek near the mouth of the user or the fleshy area under the user's chin, and the vibrations include that arising from the user's speech are conducted to the surface of the fleshy area of the user's cheek through the flesh of the user's cheek or the surface of the fleshy area under the user's chin through the flesh of the user's chin.

4. The transducer apparatus according to claim 3, wherein the hole is adapted to be covered by a membrane.

5. The transducer apparatus according to claim 1, wherein the non-boney and non-cartilaginous part of the user's head is the fleshy area under the user's chin.

6. The transducer apparatus according to claim 1, further comprising an acoustical-sensing microphone having an output, wherein the transducer having an output, and either the output of transducer or the output of the acoustic sensing-microphone or both outputs is connected to an input of an electronic device.

7. The transducer apparatus according to claim 6, further comprising a sensor, wherein when the sensor senses the transducer touching the skin of the user, the output of the transducer is connected to an input of an electronic device.

8. The transducer apparatus according to claim 1, wherein said transducer apparatus is a earset or headset having an arm with two ends, one end is connected to said earset or headset, and other end is adapted to at least embody the transducer.

9. The transducer apparatus according to claim 1, wherein the transducer is placed within a helmet or in its assembly.

10. The transducer apparatus according to claim 1, wherein the transducer is placed within a helmet or its assembly, said helmet having straps, said transducer is placed under, over or within the straps, and when said helmet is worn by the user with the straps strapped, the transducer is arranged to be placed on or pressed against said non-boney and non-cartilaginous part of the user's head.

11. The transducer apparatus according to claim 6, wherein the electronic device has computation means, and when the computation means ascertain that acoustical sounds sensed by acoustical-sensing microphone is noisy or that vibrations sensed by the transducer is noisy, the output of the transducer is connected to the input of an electronic device.

12. The transducer apparatus according to claim 6, wherein the electronic device having a first and second signal processing circuit, the first signal processing circuit is connected to the output of the acoustical-sensing microphone, a second signal processing circuit is connected to the output of the transducer, and either first or second or both signal processing circuit may be a passive circuit or active circuit, or a filter, or an amplifier, or an attenuator.

13. The transducer apparatus according to claim 1, wherein the transducer apparatus is at least in part embodied within an enclosure, and the enclosure having adaptations to be affixed to a helmet.

14. The transducer apparatus according to claim 13, wherein the enclosure having an arm with two ends, one end is connected to the enclosure, and the other end is adapted to at least embody the transducer.

15. The transducer apparatus according to claim 13, wherein the arm is adapted such that its length does not reach beyond the side of the mouth of the user.

16. The transducer apparatus according to claim 15, wherein the angle of the arm is approximately vertical.

17. The transducer apparatus according to claim 1, wherein the transducer is adapted to sense vibrations on the surface of a face mask, and the vibrations arise from the user's voiced and unvoiced sounds.

18. The transducer apparatus according to claim 17, wherein part of the transducer apparatus is embodied within an enclosure, the transducer is embodied in another enclosure, and a cable is adapted to be connected between the transducer and the enclosure.

19. The transducer apparatus according to claim 18, wherein the transducer is embodied in an enclosure, and the enclosure of the transducer and surface of the face mask are arranged such that they can be affixed to each other either physically or magnetically.

20. The transducer apparatus according to claim 1, wherein the vibrations are not due to bone conduction.

* * * * *